US006568974B2

(12) United States Patent
Semeia

(10) Patent No.: US 6,568,974 B2
(45) Date of Patent: May 27, 2003

(54) SWIM AND SCUBA FIN

(75) Inventor: Roberto Semeia, Cogorno (IT)

(73) Assignee: Scubapro Europe S.r.l., Casarza Ligure (IT)

( * ) Notice: Subject to any disclaimer, the term of this patent is extended or adjusted under 35 U.S.C. 154(b) by 0 days.

(21) Appl. No.: 09/962,238

(22) Filed: Sep. 26, 2001

(65) Prior Publication Data

US 2002/0039865 A1 Apr. 4, 2002

(51) Int. Cl.[7] ..... A63B 31/08
(52) U.S. Cl. ..... 441/64
(58) Field of Search ..... 441/64

(56) References Cited

U.S. PATENT DOCUMENTS

| | | | | |
|---|---|---|---|---|
| 2,321,009 A | | 6/1943 | Churchill | |
| 2,737,668 A | | 3/1956 | Cressi | |
| 2,779,077 A | | 1/1957 | Kline | |
| 3,082,442 A | | 3/1963 | Cousteau et al. | |
| 3,411,165 A | * | 11/1968 | Murdoch | 441/64 |
| 3,810,269 A | | 5/1974 | Tabata et al. | |
| 4,300,255 A | | 11/1981 | Beuchat | |
| 4,737,127 A | | 4/1988 | Lamont | |
| 4,838,824 A | | 6/1989 | McCredie | |
| 5,163,859 A | * | 11/1992 | Beltrani et al. | 441/61 |
| 5,183,424 A | | 2/1993 | Field | |
| 5,304,081 A | | 4/1994 | Takizawa | |
| 5,358,439 A | * | 10/1994 | Paolo | 441/64 |
| 5,387,145 A | | 2/1995 | Wagner | |
| 5,435,764 A | * | 7/1995 | Testa et al. | 441/64 |
| 5,443,593 A | * | 8/1995 | Garofalo | 441/64 |
| 5,702,277 A | | 12/1997 | Wagner | |
| 5,746,631 A | | 5/1998 | McCarthy | |
| 5,810,629 A | * | 9/1998 | Parr | 441/64 |
| 6,050,868 A | | 4/2000 | McCarthy | |
| 6,095,879 A | | 8/2000 | McCarthy | |
| 6,146,224 A | | 11/2000 | McCarthy | |
| 6,183,327 B1 | | 2/2001 | Meyer | |

FOREIGN PATENT DOCUMENTS

| | | |
|---|---|---|
| DE | 259353 | 8/1988 |
| EP | 0308998 | 3/1989 |
| EP | 0436927 | 7/1991 |
| EP | 0579046 | 1/1994 |
| EP | 0607568 | 7/1994 |

* cited by examiner

*Primary Examiner*—Stephen Avila
(74) *Attorney, Agent, or Firm*—James Creighton Wray; Meera P. Narasimhan

(57) ABSTRACT

The invention relates to a swim fin, comprising a seat for the foot, the so-called footpocket (1) and a propelling blade (102, 202), the fin being composed of at least two materials, whereof one is comparatively rigid and substantially inextensible and the other is comparatively soft, i.e. has a different rigidity and/or is extensible. According to the invention, the at least one comparatively rigid material forms a frame (4) for the blade (102, 202) and/or footpocket (1), designed to be overmolded with the part/s (101, 201, 301, 302, 402, 502, 105) made of the at least one comparatively soft material, which complete and/or connect and/or cover, at least partly, the parts of the frame (4).

40 Claims, 8 Drawing Sheets

SECTION D-D

SECTION E-E

SECTION B-B

SECTION C-C

SECTION A-A

SWIM AND SCUBA FIN

BACKGROUND OF THE INVENTION

The invention relates to a swim fin, comprising a seat for the foot, the so-called footpocket and a propelling blade, the fin being composed of at least two materials, whereof one is comparatively rigid and substantially inextensible and the other is comparatively soft, i.e. has a different rigidity and/or is extensible.

Various types of fins having the above characteristics are known.

While these prior art fins have such a construction as to ensure a higher effectiveness as compared with traditional fins, they do not achieve an ideal hydrodynamic behavior. Moreover, during overmolding, it is often difficult to match and position the various parts the fin. In fact, the comparatively rigid parts of the frame are molded separately and then disposed in a mold for injection thereon of the additional material/s which complete the fin. In this step the various parts of the fin may easily be displaced relative to each other and/or to the surfaces of the mold.

SUMMARY OF THE INVENTION

Therefore, the present invention has the purpose to improve, by simple and inexpensive arrangements, a fin such as the one described hereinbefore, to achieve a better hydrodynamic behavior, closer to the optimum. Particularly, the aim is to diversify the rigidity and softness characteristics of the various parts of the fin, in order both to obtain an optimized transmission of the translational motion from the foot to the fin blade and to improve the hydrodynamic behavior of the blade. The fin shall have an inexpensive construction and allow to reduce and/or simplify the number of fabrication steps as compared with prior art fins of the same type. Another aim is a consistently safe and accurate positioning of the parts of the fin in the molding step.

The invention achieves the above purposes by providing a fin as described herein before, wherein the at least one comparatively rigid material forms the frame of the blade and/or footpocket. The part/s made of the at least one comparatively soft material may be then overmolded on the frame, which parts complete and/or connect and/or cover, at least partly, the various parts of the frame.

The comparatively rigid material which forms the frame may be a synthetic thermoplastic material, such as EVA or the like, whereas the comparatively soft material may be thermoset rubber or the like.

The frame made of the comparatively rigid material may include a pair of longitudinal members which form the cores of a pair of side frame members of the blade, said cores being arranged to be later covered, at least partly, by overmolding them with the comparatively soft material.

Advantageously, the cores of the side frame members may be provided with means for holding them in position inside the mold when they are overmolded with the soft material.

Said means for holding the cores in position may consist of at least a pair of parts projecting out of the surface of each core, which extend from diametrically opposite sides with respect to the longitudinal center axis of the core, and which are arranged to be clamped by the two mold and countermold parts when the latter are completely closed for soft material overmolding. Hence, any displacement of the cores relative to each other and/or to the two mold halves is prevented.

These retaining projections may be oriented in a direction substantially perpendicular to each blade face, i.e. to the parting plane between the mold and the countermold.

The retaining projections may be continuous and crest-like, and extend for at least a portion or for the whole longitudinal extension of each core, or be discontinuous and disposed in a predetermined arrangement over the length of each core.

The frame made of the comparatively rigid material may include at least a pair, but preferably a plurality of ribs which form more rigid and substantially inextensible blade parts.

The ribs may branch off from the cores of the side frame members and be connected thereto by being made of one piece therewith or by chemical and/or physical bonding, and are preferably made of the same comparatively rigid and substantially inextensible material.

The ribs may be at a distance from each other and each gap between each pair of adjacent ribs may be at least partly closed by a membrane-like element or the like, obtained by overmolding it with the at least one comparatively soft and/or extensible material.

The membranes which connect the adjacent ribs may advantageously be made of the same material used for covering the cores of the side frame members, such as thermoset rubber or the like, or of one or more different materials.

The ribs may extend from the cores of the side frame members up to the edges of a longitudinal median notch of the blade, which divides it into two half-blades.

Within each half-blade, the ribs may be substantially parallel.

The ribs may be disposed symmetrically with respect to the median longitudinal axis of the blade, i.e. with respect to the median longitudinal axis of the blade.

The ribs may be oriented toward the free end of the blade, so that each of them forms an acute angle with the portion of the side frame member included between the rib attachment area and the free end of the side frame member.

The ribs may preferably have a flat shape, and be all of the same length and/or thickness.

At least some of the ribs may have one or more upper and/or lower ribbed portions for further stiffening.

The membranes for closing the gaps between every pair of adjacent ribs may be equal or different in width to each other and/or to the ribs.

The closing membranes may have the same thickness as the ribs, so as to extend flush with both half-blade faces, or have a different, particularly lower thickness.

Advantageously, the closing membranes may have a bellows-shaped cross section, to improve the extensibility characteristics of the closing elements between the ribs.

Within each half-blade, at the free end portion thereof, there may be provided at least one end rib branching off the side frame member and extending to the edge of the free end of the half-blade.

In accordance with a preferred embodiment of the invention, the frame made of the comparatively rigid material may also include a footpocket frame, which may be steadily connected to the cores of the side frame members by being made of one piece therewith or by chemical and/or physical bonding. The footpocket may be further completed by overmolding it with one or more parts made of a comparatively soft material.

These parts made of a comparatively soft material, which complete the footpocket, may include the portion in contact with the instep and/or an inner comfortable cover and/or non-slip members at the lower face of the footpocket and/or additional parts, such as a fastening strap made of one piece with the footpocket.

Advantageously, the frame of the footpocket may itself have one or more projections for locking it in position, which cooperate with the surfaces of the two mold parts when the latter are closed, in the same manner as described above for the side frame members and still aimed at preventing any relative motion of the parts of the footpocket in the molding step.

In accordance with a preferred embodiment of the invention, the whole frame of the fin may be made of a single material, or the frame of the footpocket may be made of one or more materials differing from the material/s of the cores of the side frame members and/or of the ribs.

Also, according to a preferred embodiment, all the comparatively soft parts of the fin may be made of a single material, wherewith the frame is overmolded, or two or more different materials may be provided.

The frame of the footpocket may extend at and form the bottom wall of the footpocket, so that the latter may be stiffened in a highly stressed portion.

According to a preferred embodiment, the frame of the footpocket may also extend in the upper portion of the foot, and create a seat which surrounds substantially the whole foot, to obtain an optimized transmission of the translational motion from the foot to the blade.

The advantages of the present invention are clearly shown by the above description and consist in the possible improvement of prior art fins of the same type, by using simple and inexpensive arrangements, to obtain a better hydrodynamic behavior. Thanks to the characteristics of the fin of this invention, an optimized diversification of the rigidity and softness characteristics of the parts of the fin may be achieved. In some types of prior art fins, this diversification is typically obtained by thickness variations of the fin parts, a single material being used in the whole fin, wherefore the result is never optimal. The fin of the invention is inexpensive as regards construction and allows to reduce and/or simplify the number of fabrication steps as compared with prior art fins of the same type. In fact these typically include several elements made of a comparatively rigid material which are to be joined together and with the comparatively soft parts, whereas the preferred embodiment of this invention advantageously includes a frame formed by a single element, which may be molded in one step and joined to the other parts by a single additional overmolding step. Moreover, thanks to the locking projections on the cores of the side frame members and/or in the shell of the footpocket, the parts of the fin may be always positioned in a safe and certain manner, particularly the comparatively rigid parts with respect to the comparatively soft parts. Yet a further advantage consists in a reduced use of the comparatively soft material, typically thermoset rubber or the like which is known to be a rather costly material, compensated by an increased use of the comparatively rigid material, typically a thermoplastic material or the like, which is known to be a less expensive material, whereby the total fabrication costs of the fin are lowered, without affecting the functionality thereof.

Referring to another characteristic which may be provided in any type of fin having a blade composed of two half-blades or of two half-wings separated in the median area at least partly by a longitudinal notch, the half-blades or the half-wings bear elements on one, on the other or on both faces to control bending in one, in the other or in both bending directions of the half-blades or wings.

Advantageously these control elements consist of control notches which cooperate with longitudinal ribs, especially with the side frame members of the blade.

An additional improvement provides that the bending control notches or abutments are positioned, or have surfaces that limit abutment, against the longitudinal ribs, particularly the side frame members of the blade to define, at the end of the bending stroke of each blade part or of each wing, a particular bending shape, especially an approximately helical shape.

In combination with the fin of the above description, the control notches or abutments are borne by the ribs integral with the core of each side frame member.

Thanks to this arrangement, not only is a precise deformation of the half-blades or of the wings obtained in the maximum bending condition but, by avoiding excessive bending deformations and by always keeping deformations well defined in terms of shape, the stress of the material is limited and the fin has a longer life.

Further characteristics and possible improvements of the invention will form the subject of the dependent claims.

The characteristics of the invention and the advantages derived therefrom will be more apparent from the following detailed description of a preferred embodiment shown in the annexed drawings, in which:

DETAILED DESCRIPTION OF THE PREFERRED EMBODIMENTS

Figure 1:
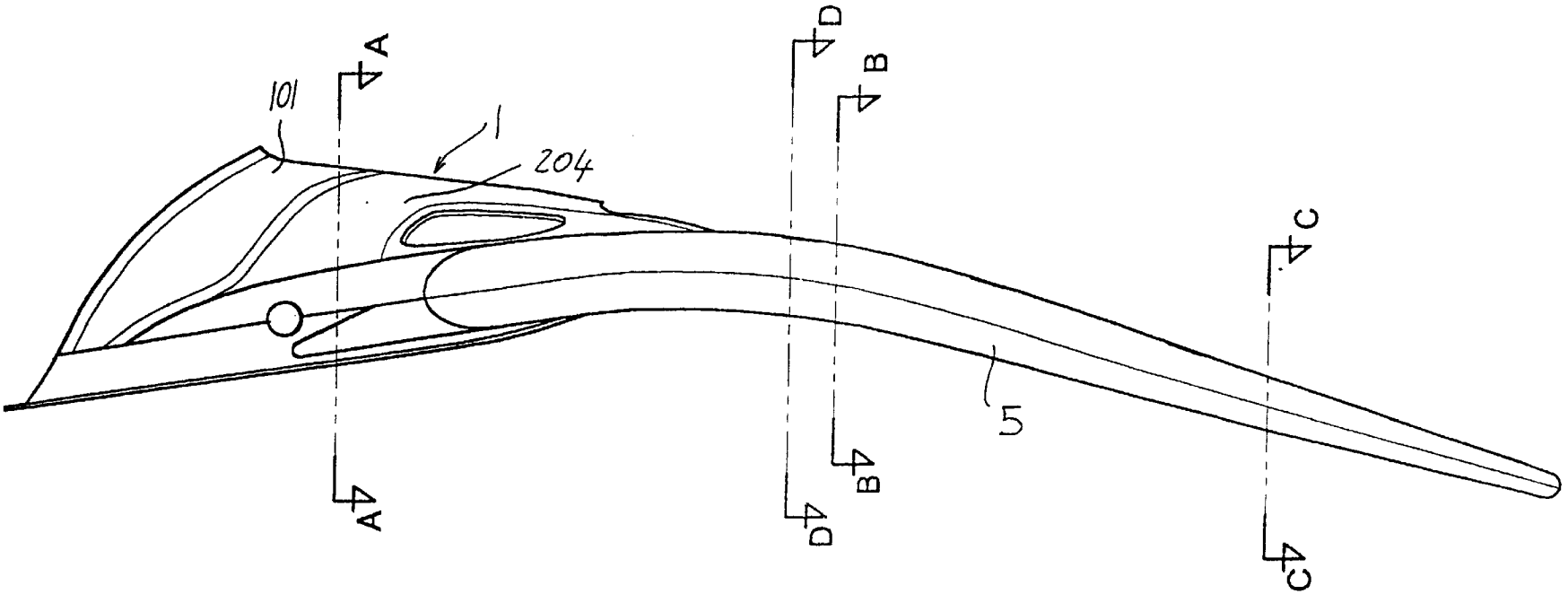
FIG. 1 is a side view of a preferred embodiment of the fin according to the invention.
Figure 2:
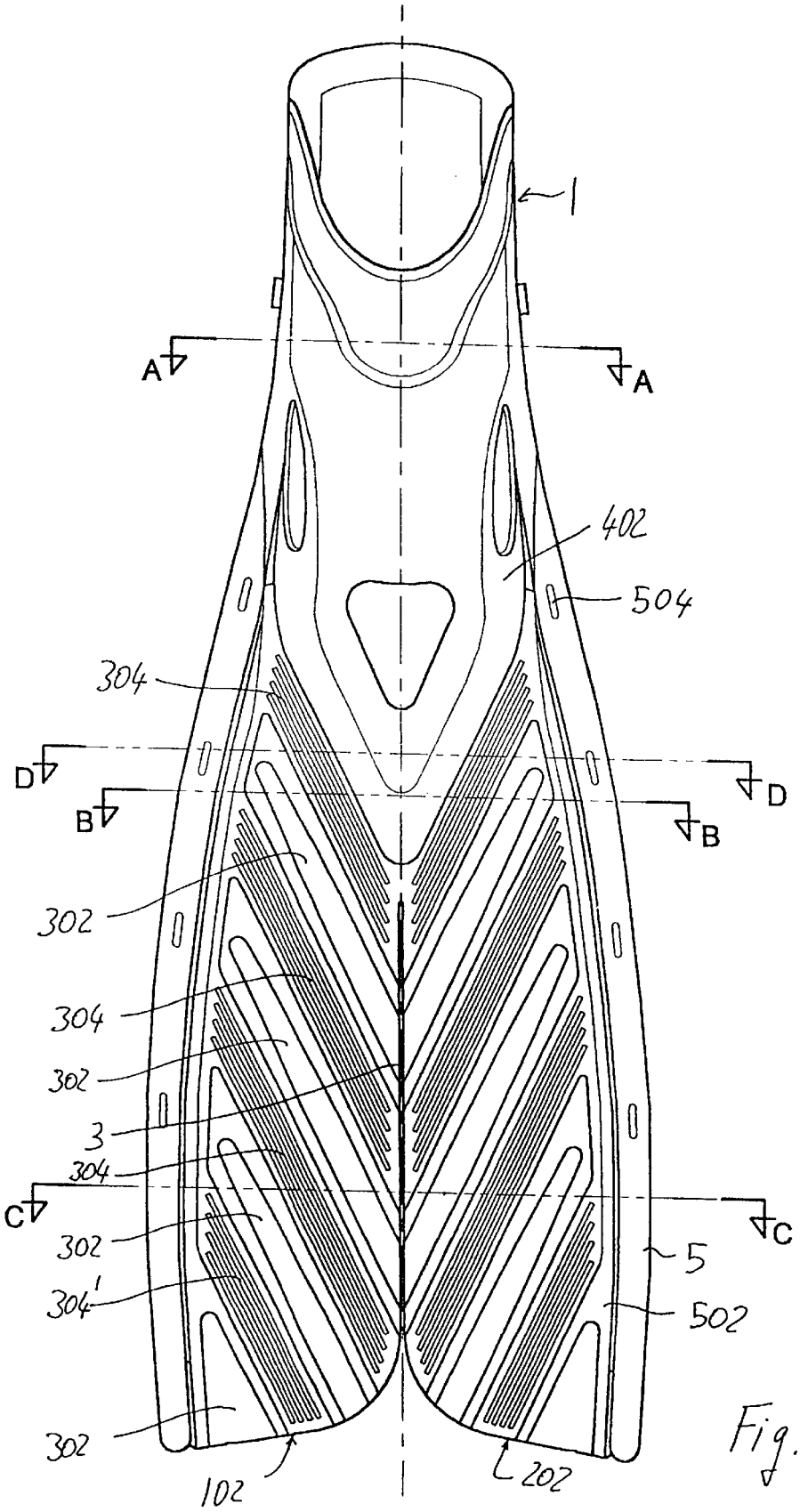
FIG. 2 is a top plan view of the fin as shown in FIG. 1.

Referring to FIG. 2, the fin is composed of a seat for the foot, the so-called footpocket 1, and of a blade part.

The footpocket 1 may be of the closed type, of the open-heel type as shown in the Figures or of any other type. The blade part is divided into two half-blades 102, 202 by a median longitudinal notch 3 of the blade. This notch 3 extends from an area close to the tip of the footpocket 1 to the edge of the free end of the blade.

Figure 3:
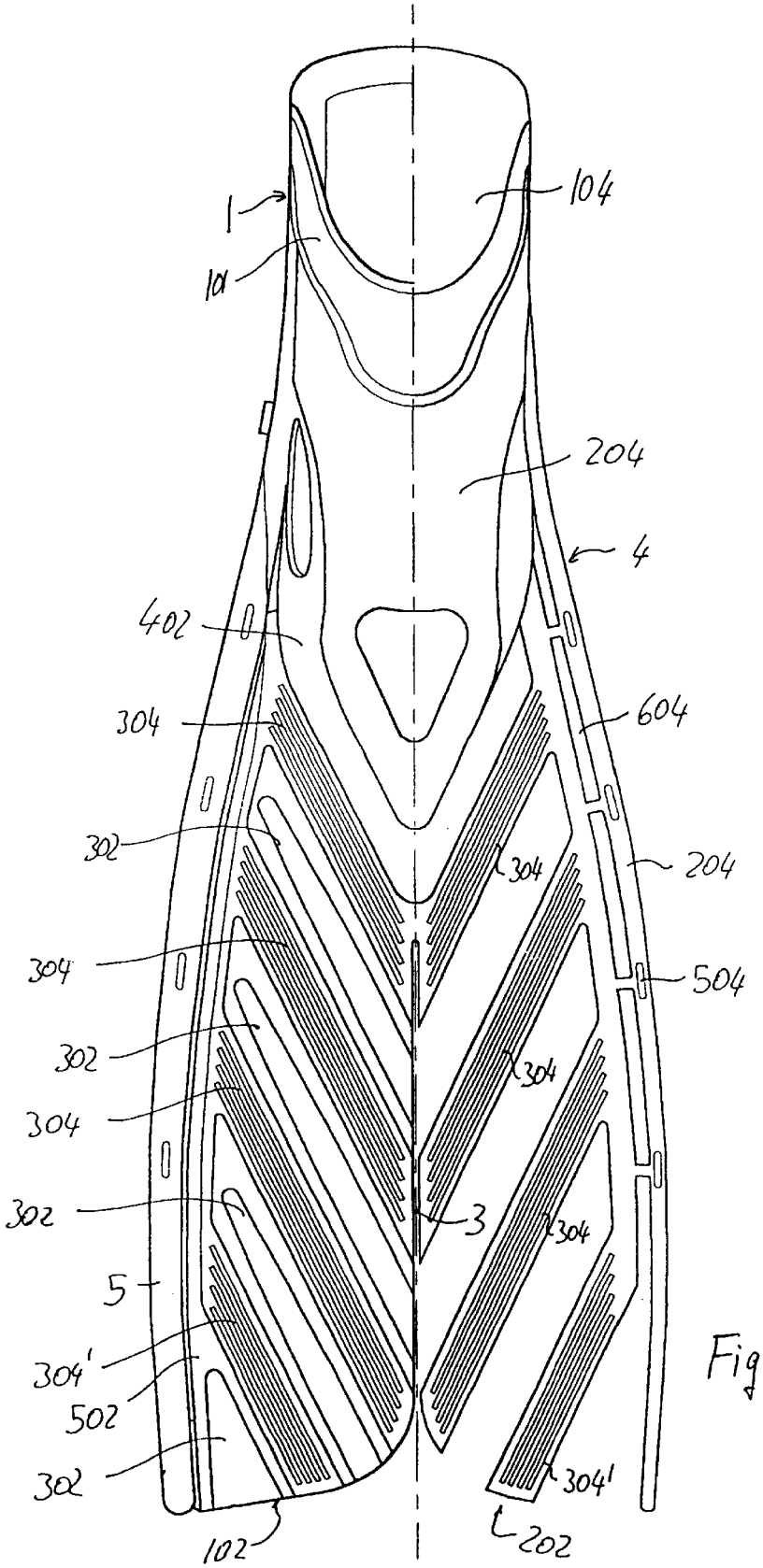
FIG. 3 is a top plan view of the fin, wherein only the frame made of the comparatively rigid material of the fin shown in FIG. 1 is visible in the right half, whereas the left half shows the finished fin.
Figure 4A:
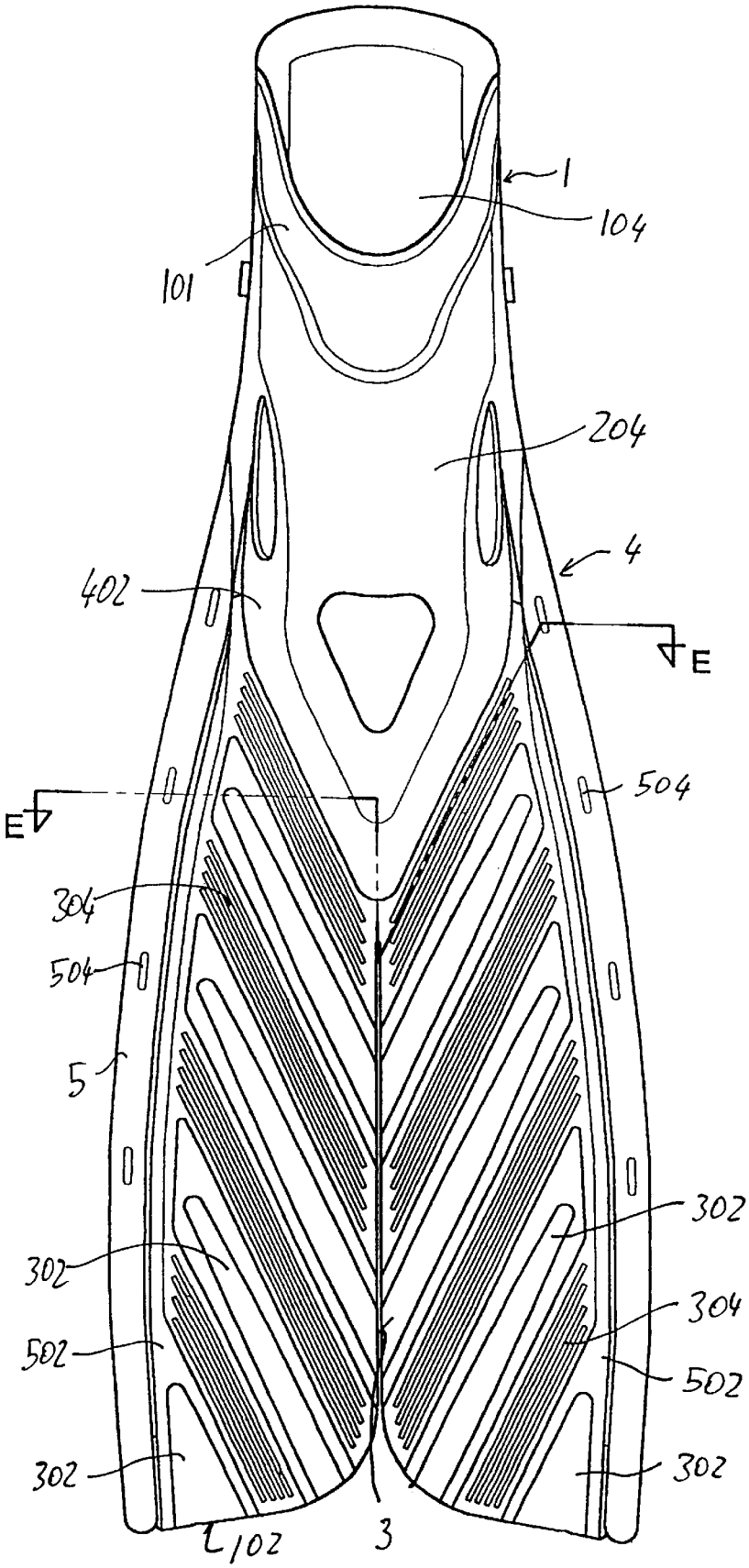
FIG. 4*a* is the same view as the one of FIG. 2, wherein the section broken line EE is shown.
Figure 4B:
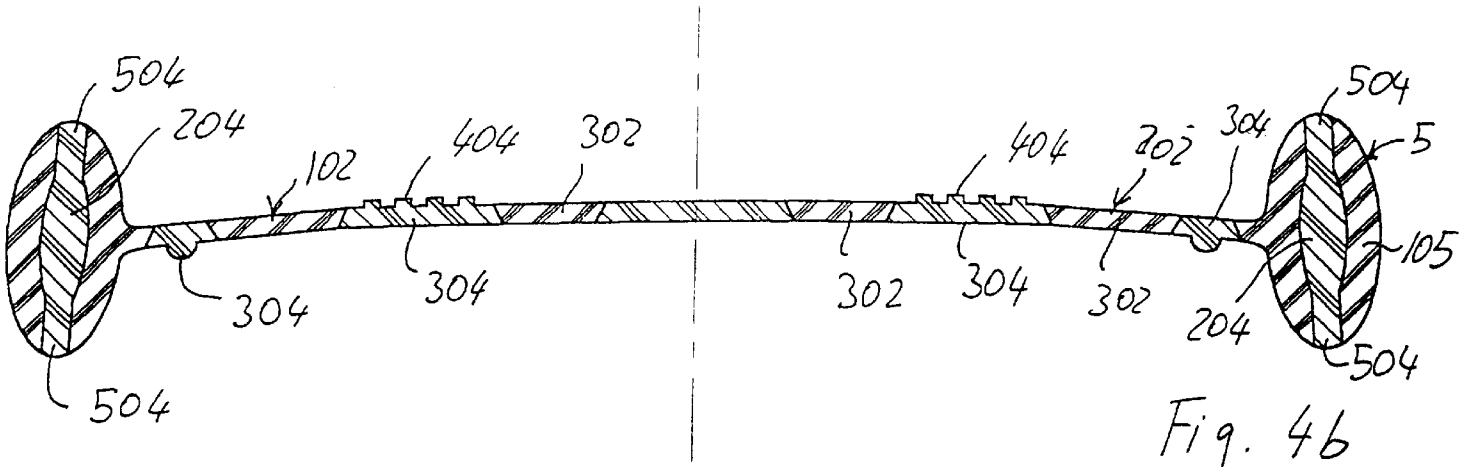
FIG. 4*b* shows the section as seen through the line DD of FIG. 2.
Figure 4C:
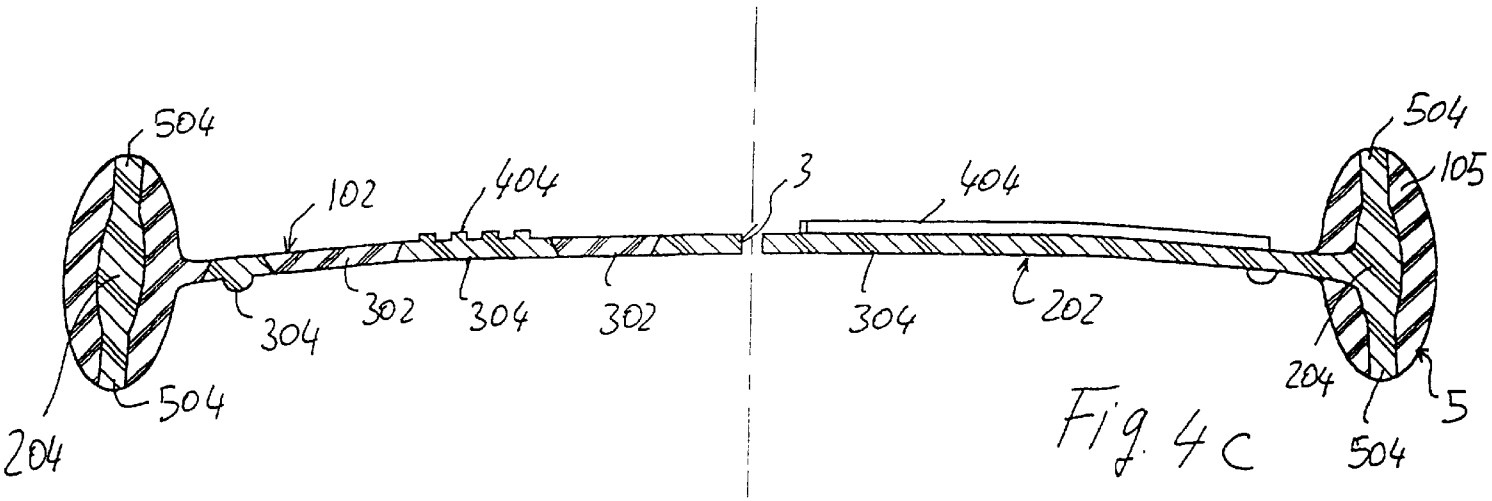
FIG. 4*c* shows the section as seen through the line EE of FIG. 4*a*.

Referring to FIG. 3, the fin includes a supporting and stiffening frame, denoted as 4 in this Figure, which extends both in the footpocket area 1 and in the blade part area, i.e. in the area of the two half-blades 102, 202. In accordance with a preferred embodiment, this frame 4 is made of a single comparatively rigid and substantially inextensible material, nevertheless provided with a certain flexibility. Suitable materials include many thermoplastic materials, such as EVA or the like. Anyway, two or more different materials may be used for making the various parts of the frame 4. This frame 4 may be fabricated separately by molding, whereas all the other parts which complete and/or connect and/or cover, at least partly, the parts of the frame 4 may be fabricated in a second step by overmolding the parts of the frame 4 with a single comparatively soft and extensible material. However, here again more materials may be used for fabricating the comparatively soft parts of the fin.

The frame 4 includes, on two side frame members disposed longitudinally and laterally with respect to each half-blade 102, 202, parts for relatively stiffening the surface of each half-blade 102, 202 and of the footpocket 1. In accordance with a preferred embodiment of the invention, all these parts are made in a single molding step and in such a manner as to be fabricated of one piece, to form a single "skeleton" for supporting the fin. However, the parts of the frame 4 may be made separately and joined together by chemical and/or physical bonding.

Figure 7:
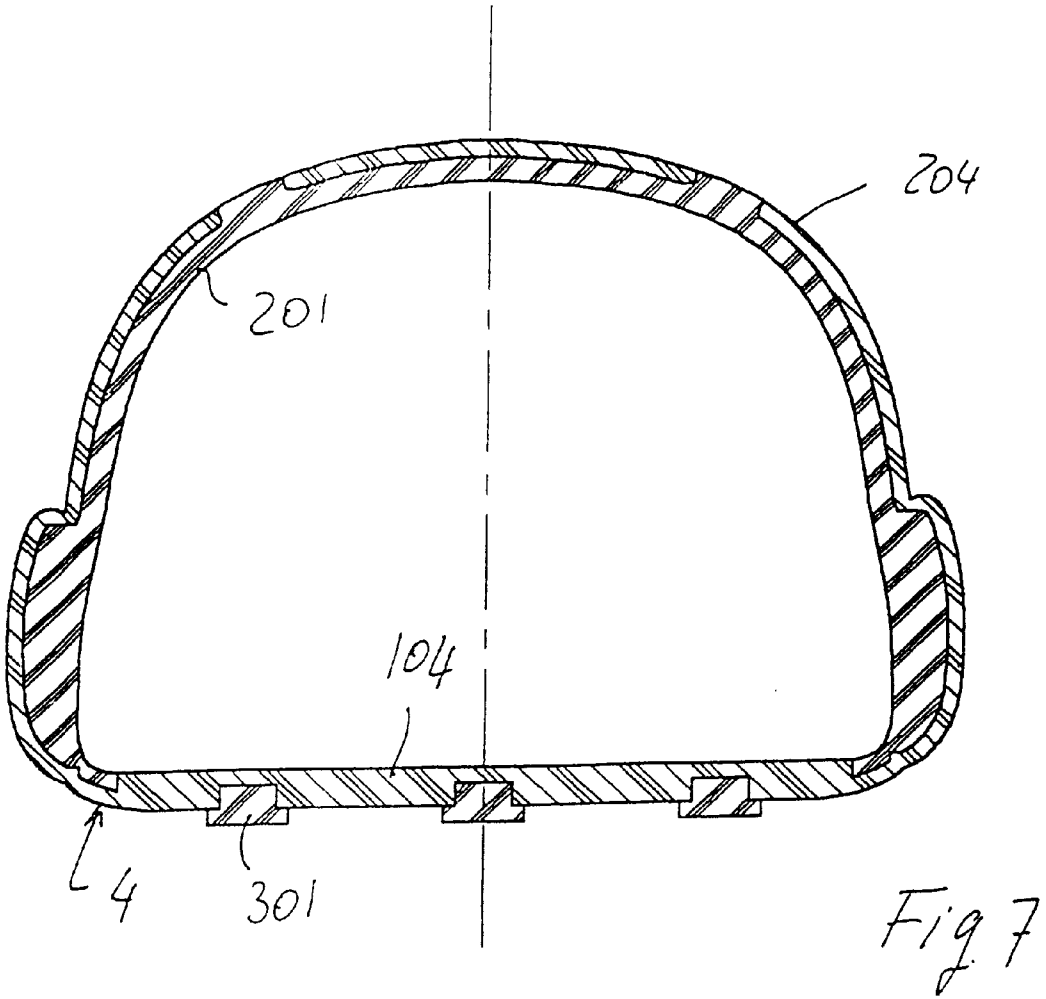
FIG. 7 is a sectional view of the footpocket as seen through the line AA of FIG. 1.

The frame part 4 in the footpocket area 1 extends at and forms the bottom wall 104 of the footpocket 1. Advantageously, it also extends along the upper portion 204 of the foot (see also FIG. 7), thereby creating a seat which surrounds substantially the whole foot, particularly in the area corresponding to the metatarsus of the user. The footpocket 1 is later completed by overmolding it with parts made of a comparatively soft material, particularly to create the portion 101 of the footpocket in contact with the instep. An inner cover 201 of the footpocket 1 is further provided, still from a comparatively soft material, to provide foot comfort, which may consist of an extension of the part 101 inside the part 204 of the frame 4 or upper shell of the footpocket 1. The bottom wall 104 of the footpocket 1 further has a few portions 301, still in a comparatively soft material and also overmolded, which have non-slip functions.

Figure 5:
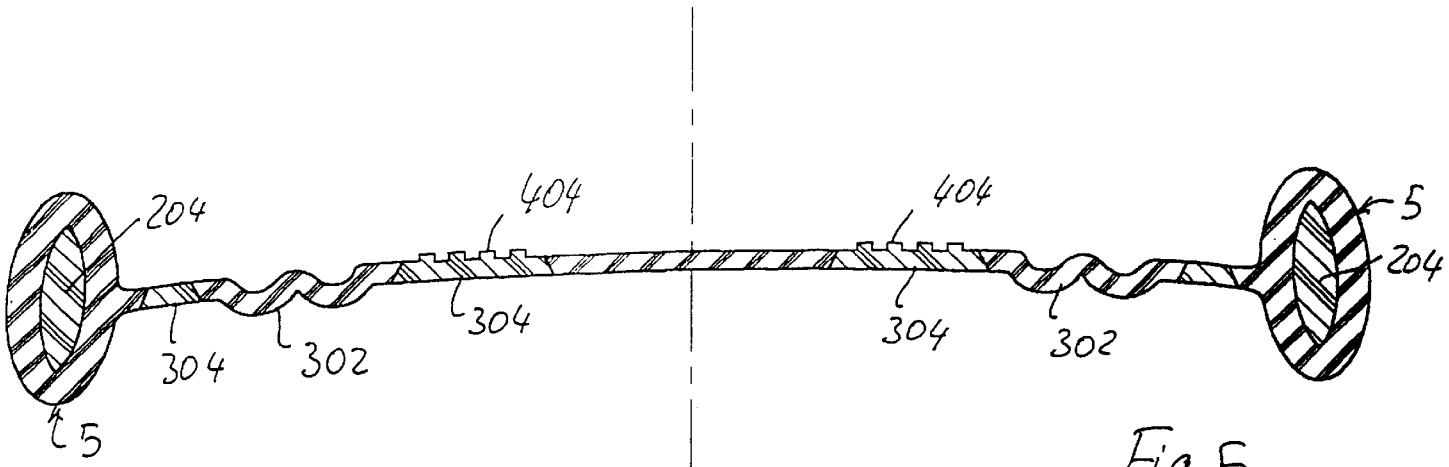
FIG. 5 is a sectional view of the blade as seen through the line BB of FIG. 1.
Figure 6:
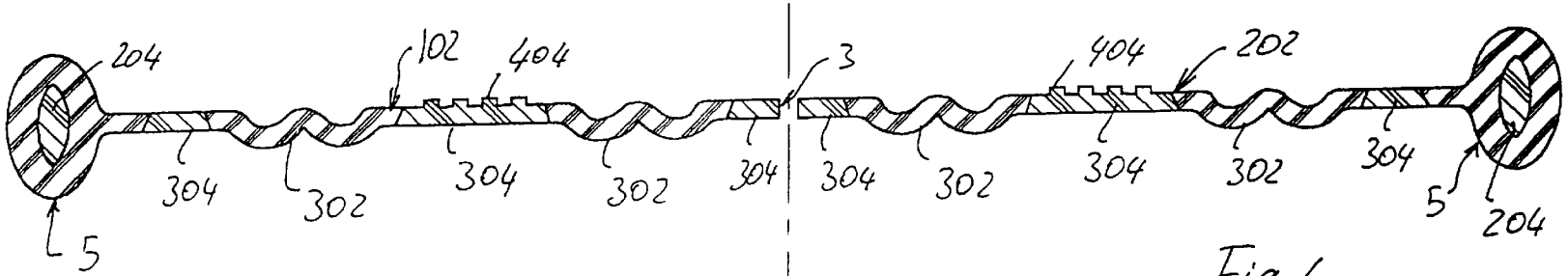
FIG. 6 is a sectional view of the blade as seen through the line CC of FIG. 1.

The frame part 4 of the footpocket 1 is connected to a pair of longitudinal, comparatively rigid elements 204 (FIG. 3), each forming the core 204 of a side frame member 5 of the half-blade 102, 202 (FIG. 3). These core elements 204 extend each from a side portion of the frame 104, 204 of the footpocket 1 to the edge of the free front end of each half-blade 102, 202. These core elements 204 have a substantially elliptic shape, or similar, with the longer axis oriented substantially perpendicularly to the half-blade faces 102, 202 to provide effective stiffening of the side edges of the half-blades 102, 202. These core elements 204 have a decreasing section toward the free ends of the half-blades 102, 202 (see particularly FIGS. 5 and 6) to provide higher flexibility in this area. Then, each core element 204 is covered 105 by overmolding it with the comparatively soft material to form a complete side frame member 5.

A plurality of ribs 304 (FIGS. 3 and 4*a*, 4*b*, 4*c*) extend from the face of each core element 204 turned toward the median longitudinal notch 3 of the blade to the edge of the notch 3, and form the elements for supporting and partially stiffening the surface of each half-blade 102, 202. These ribs 304 have a flat face, are all substantially of the same length, width and thickness and are oriented toward the front free end of each half-blade 102, 202. As clearly shown in FIGS. 4*a*, 4*b*, 4*c*, 5 and 6, they are upwardly ribbed 404 for further stiffening. Within each half-blade 102, 202 the end rib 304' situated near the free end of the side frame member 5 ends at the front free end of the half-blade 102, 202 and is shorter than all the others.

The ribs 304 are disposed at a constant distance from each other and each gap between each pair of adjacent ribs 304 is closed by a membrane-like element 302, obtained by overmolding with the comparatively soft and extensible material. This material also forms the area 402 which connects the front portion of the footpocket 1 with the pair of nearest ribs 304 and also covers, at least partly, the area 502 which connects the ribs 304 and the cores 204 of the side frame members 5.

Therefore, the surface of each half-blade 102, 202 appears like a continuous surface, delimited by the two side frame members 5 and by the median notch 3 and formed by a plurality of comparatively rigid portions 304 arranged in a comb-like configuration wherein the teeth are oriented toward the front free end of the half-blade, alternating with comparatively soft portions 302. The comparatively soft material may be also arranged to completely cover the frame 4.

The membranes 302 between each pair of adjacent ribs 304 are substantially as thick as the ribs 304 and extend flush therewith. The side edges of the ribs 304 are inclined in such a manner as to increase the contact and junction surface between the ribs 304 and the closing membranes 302.

The closing membranes (FIGS. 5 and 6) may also have a bellows shaped cross section to increase their compliance characteristics.

Back to FIG. 3, each core element 204 has a plurality of parts 504 projecting out of the surface of each core 204, which extend from diametrically opposite sides with respect to the longitudinal center axis of the core 204, and which are arranged to be clamped by the two mold and countermold parts when the latter are completely closed for soft material overmolding. By this arrangement, any displacement of the cores 204 relative to each other and to the two mold halves is prevented, and the soft parts are accurately positioned with respect to the comparatively rigid parts, thereby preventing any fabrication of defective products. Once the comparatively soft material is injected, the free ends of said projections 504 extend flush with the front and rear surfaces of the side frame member 5 and form small exposed parts of comparatively rigid material. Thanks to the presence of the projections 504 on the cores 204 of the side frame members 5, the ribs 304 which have a relative mobility caused by the median longitudinal notch 3 of the blade, may be also held in their proper position when the comparatively soft material is molded thereon.

Furthermore, by providing that the frame 4 of the fin includes both the frame or skeleton 204, 304, 304' of the blade 102, 202 and the frame or shell 104, 204 of the footpocket 1, either fastened together or as a single piece, the fabrication steps may be reduced and any improper positioning of the two parts may be avoided.

The fin frame part 4 may be of the same color as the parts made of the comparatively soft material or of one or more different colors, to show its functional features.

Referring to another characteristic which may be provided in any type of fin having a blade composed of two half-blades 102, 202 or of two half-wings formed in the blade, the half-blades or the wings being separated in the median area at least partly by a longitudinal notch 3, the half-blades or the half-wings bear elements (10), on one, on the other or on both faces, to control bending in one, in the other or in both bending directions of the half-blades or wings.

These control elements (10) are arranged over the length of the blade or of the corresponding half-blade (102, 202). Advantageously these control elements (10) consist of control notches, abutments or projections which cooperate with longitudinal ribs, especially with the side frame members (5) of the blade (2).

An additional improvement provides that the bending control notches or abutments (10) are positioned or have surfaces (110) to control bending by abutment against the longitudinal ribs, particularly the side frame members (5) with different orientations with respect to the position on the length of the blade to define, at the end of the bending stroke of each blade part or of each wing, a particular bending shape, especially an approximately helical shape.

Figure 8:
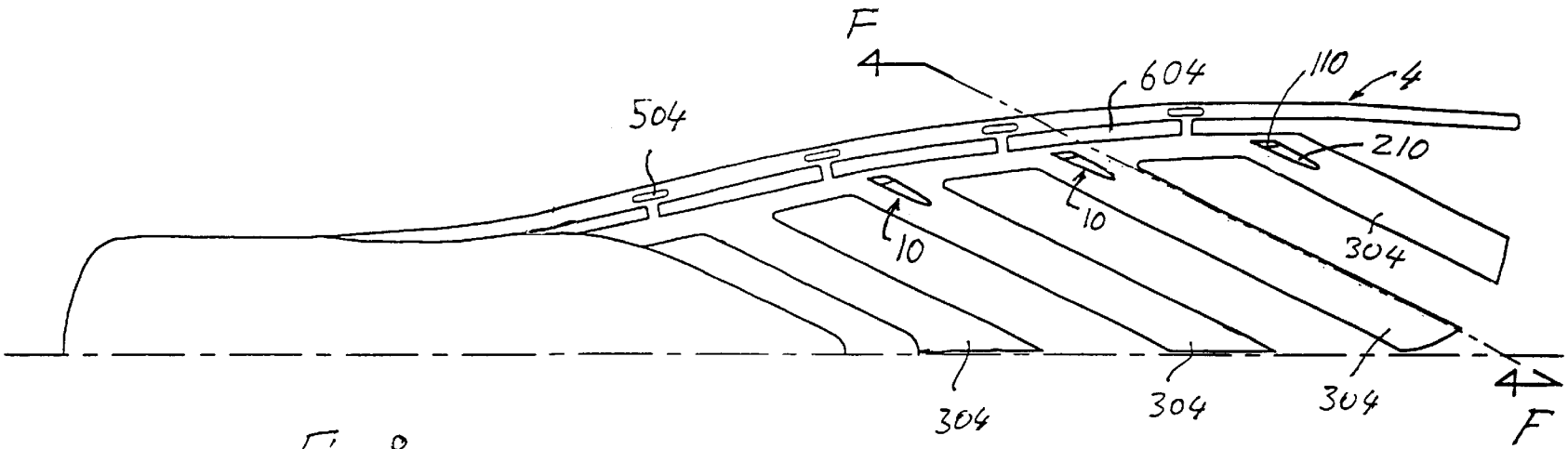
FIG. 8 shows a half of the fin frame separated by the longitudinal axis thereof.
Figure 10:
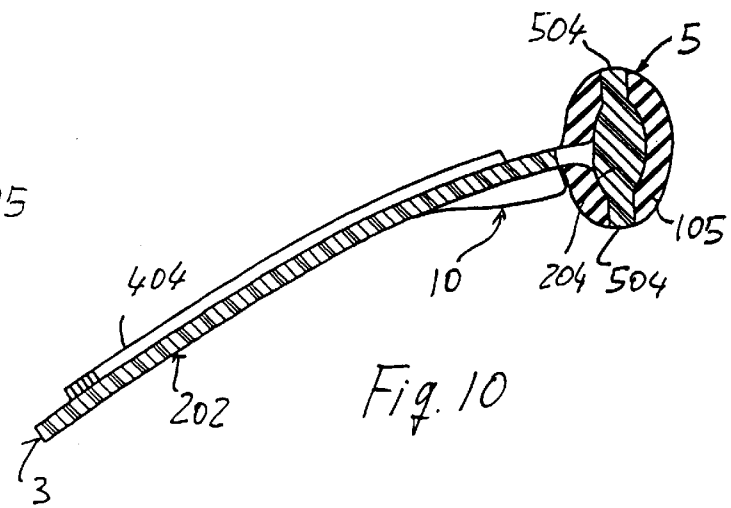
FIG. 10 shows the same section as FIG. 9, but with the blade in the bent condition during the forward fin motion.
Figure 9:
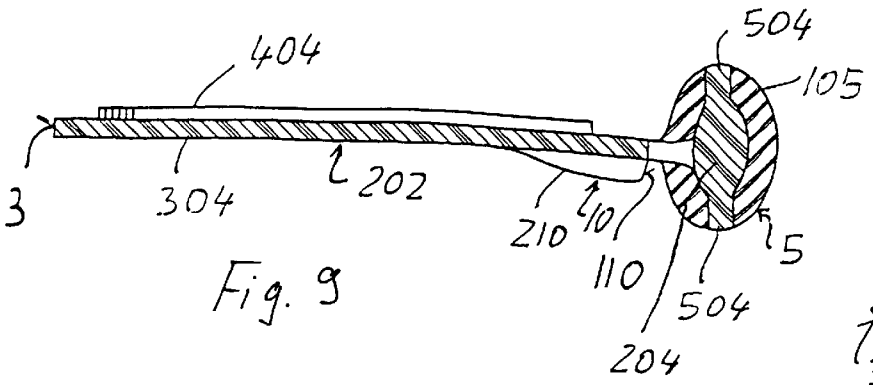
FIG. 9 shows the section as seen through the line FF of FIG. 8 and with the blade in the rest condition.

As is apparent from FIGS. 8 to 10, the face 110 may have several different inclinations depending on the position of the bending control element 10 relative to the longitudinal extension of the blade. Moreover, the elements 10 may have a part 210 which extends along a certain portion of the rib 304. If this is the case, the extension 210 is an element to further control bending of the wing and the half blade as well as the shape formed thereby in the bent condition, in the proximity of said rib 304. By controlling the height of the extension 210 which, in the illustrated embodiment is progressively thinner and follows a slightly concave profile, the bending resistance may be calibrated at the bending control element to control the bending curve of the half-blade at the rib 304. It has to be noted that the bending control elements are oriented to be inclined like the ribs 304. This orientation shall be considered without limitation. In fact, whether the same inclined ribs or transverse ribs, perpendicular to the median axis are provided, the bending control elements 10 may be even oriented not parallel to the ribs and perpendicular to the median longitudinal axis, i.e. to the notch 3 of the blade.

Also, the bending control elements may be also provided in combination with any type of fin blade and not only with a blade as shown in FIGS. 1 to 10.

Also, the extension 210 of the control element 10 shall not necessarily be thinned toward the free end facing the median axis of the blade, but may have any profile, even progressively thicker toward said end. The above also applies to the number of control elements 10 and to their arrangement along the blade and in certain portions thereof, as well as to the length of the control elements 10 with reference to the direction from the corresponding side frame member to the median portion of the blade.

Obviously, the invention is not limited to the embodiment described herein, but may be greatly varied, without departure from the guiding principle disclosed above and claimed below.

What is claimed is:

1. A swim fin, comprising a seat for a foot forming a footpocket (1) and a propelling blade (102, 202), the fin comprising at least two materials, wherein one material is comparatively rigid material and substantially inextensible and the other material is comparatively soft having a different rigidity than the one material and is extensible, the comparatively rigid material forming a frame (4) for the propelling blade (102, 202) and the footpocket (1), overmolded parts on the rigid material (101, 201, 301, 302, 402, 502, 105) made of the comparatively soft material, and the overmolded parts being disposed on portions of the frame (4).

2. A fin as claimed in claim 1, wherein the comparatively rigid material forming the frame (4) is of synthetic thermoplastic material and the comparatively soft material is of thermoset rubber material.

3. A fin as claimed in claim 1, wherein the frame (4) made of the comparatively rigid material comprises a blade having a pair of side frame members and a pair of longitudinal members forming cores (204) of the pair of side frame members (5) of the blade (102, 202), said cores (204) being covered (105), at least partly, by overmolding with the comparatively soft material.

4. A fin as claimed in claim 3, further comprising means (504) on the cores (204) of the side frame members (5) for holding the cores in a desired position inside a mold when the cores are overmolded with the soft material.

5. A fin as claimed in claim 4, wherein said means for holding the cores (204) in position consist of at least a pair of projections (504) projecting outward from a surface of each core (204), the projections extending from diametrically opposite sides with respect to a longitudinal center axis of the core (204), and the projections being arranged to be clamped and completely closed by two mold and countermold halves during soft material overmolding, to prevent any relative displacement between the cores (204) and the two mold and countermold halves.

6. A fin as claimed in claim 5, wherein said projections (504) are oriented in a direction substantially perpendicular to each face (102, 202) of the blade.

7. A fin as claimed in claim 5, wherein said projections (504) are continuous and crest-like, or discontinuous, and extend for at least a portion or for a whole longitudinal extension of each core (204).

8. A fin as claimed in claim 3, wherein the frame (4) made of the comparatively rigid material includes at least a pair or a plurality of ribs (304) forming more rigid and substantially inextensible blade parts (102, 202).

9. A fin as claimed in claim 8, wherein the ribs (304) extend from the cores (204) of the side frame members (5) and are connected thereto by being made of one piece therewith or by chemical and/or physical bonding, and are made of the same material as the frame.

10. A fin as claimed in claim 8, wherein the ribs (304) are at a distance from each other and each gap between each pair of adjacent ribs (304) is at least partly closed by a membrane (302) obtained by overmolding with the at least one comparatively soft and extensible material.

11. A fin as claimed in claim 10, wherein the membranes (302) connecting the adjacent ribs (304) are made of the same or different material used for covering (105) the cores (204) of the side frame members (5).

12. A fin as claimed in claim 8, wherein the ribs (304) extend from the cores (204) of the side frame members (5) up to edges of a longitudinal median notch (3) of the blade, which divides it into two half-blades (102, 202).

13. A fin as claimed in claim 12, wherein within each half-blade (102, 202), the ribs (304) are substantially parallel.

14. A fin as claimed in claim 12, wherein the ribs (304) are disposed symmetrically with respect to the median longitudinal notch (3) of the blade (102, 202), and the median longitudinal axis of the blade (102, 202).

15. A fin as claimed in claim 8, wherein the ribs are oriented towards a free front end of the blade (102, 202), so that each rib forms an acute angle with the portion of the side frame member (5) included between a rib (304) attachment area and a free end of the side frame member (5).

16. A fin as claimed in claim 8, wherein the ribs (304) have a flat shape, and are all of the same length and/or thickness.

17. A fin as claimed in claim 8, wherein at least some of the ribs (304) have one or more upper and/or lower ribbed portions (404) for further stiffening.

18. A fin as claimed in claim 11, wherein the membranes (302) for closing the gaps between every pair of adjacent ribs (304) are equal or different in width to each other and/or to the ribs (304).

19. A fin as claimed in claim 12, wherein the membranes (302) have the same thickness as the ribs (304), so as to extend flush with both half-blade faces (102, 202), or have a different lower thickness.

20. A fin as claimed in claim 11, wherein the closing membranes (302) have a bellows shaped cross section.

21. A fin as claimed in claim 12, wherein within each half-blade (102, 202), at a front free end of the half blade (102, 202), there is provided at least one end rib (304') extending from the core (204) of the side frame member (5) to an edge of the front free end of the half-blade (102, 202).

22. A fin as claimed in claim 5, wherein the frame (4) made of the comparatively rigid material includes a frame (104, 204) of the footpocket (1), connected to the cores (204) of the side frame members (5) by being made of one piece therewith or by chemical and/or physical bonding, the footpocket (1) being arranged to be later completed by overmolding with one or more parts (101, 201, 301) made of the comparatively soft material.

23. A fin as claimed in claim 22, wherein the one or more parts made of the comparatively soft material, which complete the footpocket (1), include a portion (101) in contact with an instep and/or an inner comfortable cover (201) and/or non-slip members (301) at a lower face (104) of the footpocket (1).

24. A fin as claimed in claim 22, wherein the frame (104, 204) of the footpocket (1) has one or more position locking projections which cooperate with surfaces of the two mold halves when the mold is closed, like the side frame members (5).

25. A fin as claimed in claim 22, wherein the frame (4) of the fin is entirely made of a single material, the frame (104, 204) of the footpocket (1) is made of a material differing from the material of the cores (204) of the side frame members (5) and/or of the ribs (304).

26. A fin as claimed in claim 22, wherein all the comparatively soft material parts (101, 201, 301, 302, 402, 502, 105) of the fin are made of a single or different material, and overmolded with the frame (4).

27. A fin as claimed in claim 22, wherein the frame of the footpocket (1) extends and forms a bottom wall (104) of the footpocket (1).

28. A fin as claimed in claim 27, wherein the frame of the footpocket (1) also extends in an upper portion (204) of the foot, and creates a seat which surrounds substantially the whole foot, to obtain an optimized transmission of translational motion from the foot to the blade (102, 202).

29. A fin comprising a blade (2) having a single side frame member (5) and an edge free on a side opposite to the side frame member and on a free end of the blade opposite to a footpocket or foot attachment area, or two half-blades (102, 202) or two half-wings formed in the blade, the half-blades or the two half-wings being at least partly separated in a median area by a longitudinal notch forming two faces wherein the blade or the half-blades or the half-wings comprise control elements (10) on one or both faces, to control bending in one or more bending directions of the blade or half-blades or half-wings.

30. A fin as claimed in claim 29, wherein the control elements (10) are arranged over the length of the blade or of the corresponding half-blade (102, 202) or half-wing.

31. A fin as claimed in claim 29, wherein the control elements (10) comprise control notches, abutments or projections which cooperate with longitudinal ribs, on the side frame member (5) of the blade (2) or with longitudinal members provided in areas of the wings attached to the blade.

32. A fin as claimed in claim 31, wherein the control notches or abutments (10) have surfaces (110) to control bending by abutment, against the longitudinal ribs, and the side frame member (5) of the blade, and have different orientations with respect to positions on the length of the blade.

33. A fin as claimed in claim 32, wherein said positions and orientations of the surfaces (110) abutting against the side frame member (5) are such that, at the end of a bending stroke of each part of the blade or of each half-wing, they impart a helical, bending.

34. A fin as claimed in claim 32, wherein the bending control elements (10) have an extension (210) extending for a certain length toward the edge of the blade, or half-blade, or half-wing, opposite to the side frame member or to means (5) abutting against the bending control elements (10).

35. A fin as claimed in claim 34, wherein the extension (210) further controls bending of the blade or half-blade or half-wing as well as a shape formed thereby in a bent condition, said extension (210) having a changing thickness over the length thereof.

36. A fin as claimed in claim 35, wherein the extension (210) is progressively thinner as it extends in a direction opposite to a bending control surface (110).

37. A fin as claimed in claim 34, wherein the extension (210) have any transverse inclination with respect to a longitudinal axis of the blade, which is identical for all elements or changes from element to element.

38. A fin as claimed in claim 29, wherein the fin is a scuba fin.

39. A fin as claimed in claim 38, further comprising ribs on the frame, wherein at least some of the ribs (304) of the frame comprise at least one bending control element (110).

40. A fin as claimed in claim 39, wherein the at least one bending control element (10) is oriented parallel to the rib (304) of the frame associated thereto.

* * * * *